US011056813B2

(12) United States Patent
Yin et al.

(10) Patent No.: US 11,056,813 B2
(45) Date of Patent: Jul. 6, 2021

(54) ELECTRICAL CONNECTOR ASSEMBLY WITH COMPLEMENTARY CONTACT UNIT

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Ting-Ting Yin, Kunshan (CN); Bin Peng, Kunshan (CN); Kuo-Chun Hsu, New Taipei (TW); Jian-Kuang Zhu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/726,911

(22) Filed: Dec. 25, 2019

(65) Prior Publication Data

US 2020/0203870 A1 Jun. 25, 2020

(30) Foreign Application Priority Data

Dec. 25, 2018 (CN) ..... 201811590335.8

(51) Int. Cl.
*H01R 13/11* (2006.01)
*H01R 13/04* (2006.01)
(Continued)

(52) U.S. Cl.
CPC ..... *H01R 13/113* (2013.01); *H01R 13/04* (2013.01); *H01R 43/26* (2013.01); *H01R 13/502* (2013.01); *H01R 13/631* (2013.01)

(58) Field of Classification Search
CPC .... H01R 43/26; H01R 12/716; H01R 13/521; H01R 13/6581; H01R 13/6683;
(Continued)

(56) References Cited

U.S. PATENT DOCUMENTS 7,611,386 B1 * 11/2009 Zhang ..... H01R 13/658 439/660
8,376,785 B2 * 2/2013 Lapidot ..... H01R 13/6461 439/660
(Continued)

FOREIGN PATENT DOCUMENTS

CN 106486805 B 8/2015
EP 1189310 A2 3/2002
(Continued)

*Primary Examiner* — Truc T Nguyen
(74) *Attorney, Agent, or Firm* — Ming Chieh Chang; Wei Te Chung

(57) ABSTRACT

An electrical connector assembly includes a receptacle connector and a plug connector mateable with each other. Each of the receptacle connector and the plug connector defines a first mating face and a second mating face perpendicular to each other in response to mating along the front-to-back direction and the vertical direction. Each of the receptacle connector and the plug connector includes a plurality of contacts composed of a plurality of first contacts and a plurality of contact units alternately arranged with each other along the transverse direction perpendicular to both the front-to-back direction and the vertical direction. Each contact unit includes a second contact and a third contact wherein the second contact is closer to the second mating face than the third contact is while the third contact is closer to the first mating face than the second contact is.

20 Claims, 10 Drawing Sheets

(51) Int. Cl.
*H01R 43/26* (2006.01)
*H01R 13/502* (2006.01)
*H01R 13/631* (2006.01)

(58) Field of Classification Search
CPC ..... H01R 13/502; H01R 13/6272; H01R 13/6275; H01R 13/641; H01R 2107/00; H01R 24/64; H01R 12/53; H01R 13/04; H01R 13/08; H01R 13/111; H01R 13/187; H01R 13/5202; H01R 13/622; H01R 13/631; H01R 13/703; H01R 2103/00; H01R 2105/00; H01R 2201/12; H01R 24/40; H01R 24/58; H01R 43/16; H01R 43/20; H01R 9/0521; H01R 12/707; H01R 12/718; H01R 12/72; H01R 12/724; H01R 12/75; H01R 13/03; H01R 13/10; H01R 13/112; H01R 13/113; H01R 13/15; H01R 13/193; H01R 13/20; H01R 13/2421; H01R 13/405; H01R 13/41; H01R 13/44; H01R 13/501; H01R 13/506; H01R 13/508; H01R 13/5219; H01R 13/53; H01R 13/6271; H01R 13/6277; H01R 13/635; H01R 13/639; H01R 13/6471; H01R 13/6583; H01R 13/6592; H01R 13/6593; H01R 13/6599; H01R 13/70; H01R 13/7033; H01R 13/7038; H01R 13/713; H01R 24/86; H01R 43/0256; H01R 43/205; H01R 43/24; H01R 4/185; H01R 12/515; H01R 12/57; H01R 12/58; H01R 12/585; H01R 12/7011; H01R 12/7029; H01R 12/7052; H01R 12/7064; H01R 12/7082; H01R 12/7088; H01R 12/714; H01R 12/722; H01R 12/727; H01R 12/737; H01R 12/778; H01R 12/79; H01R 13/025; H01R 13/035; H01R 13/057; H01R 13/11; H01R 13/17; H01R 13/2407; H01R 13/2414; H01R 13/2457; H01R 13/2471; H01R 13/26; H01R 13/28; H01R 13/40; H01R 13/422; H01R 13/424; H01R 13/46; H01R 13/514; H01R 13/516; H01R 13/518; H01R 13/52; H01R 13/5205; H01R 13/5213; H01R 13/5216; H01R 13/5221; H01R 13/523; H01R 13/58; H01R 13/5845; H01R 13/6205; H01R 13/623; H01R 13/6273; H01R 13/6315; H01R 13/6335; H01R 13/6392; H01R 13/6461; H01R 13/6466; H01R 13/6474; H01R 13/6485; H01R 13/6585; H01R 13/6587; H01R 13/6594; H01R 13/6598; H01R 13/66; H01R 13/6658; H01R 13/6666; H01R 13/6675; H01R 13/701; H01R 13/7032; H01R 13/7036; H01R 13/71; H01R 2201/04; H01R 2201/20; H01R 24/20; H01R 24/60; H01R 24/84; H01R 25/145; H01R 27/02; H01R 29/00; H01R 31/06; H01R 31/08; H01R 43/005; H01R 43/0221; H01R 43/0263; H01R 43/048; H01R 43/18; H01R 43/28; H01R 4/023; H01R 4/187; H01R 4/34; H01R 4/4845; H01R 9/0527; H01R 9/18
See application file for complete search history.

(56) References Cited

U.S. PATENT DOCUMENTS

| | | | | |
|---|---|---|---|---|
| 9,780,492 | B1 * | 10/2017 | Wang | H01R 13/6471 |
| 2006/0003620 | A1 * | 1/2006 | Daily | H01R 12/73 439/295 |
| 2010/0304582 | A1 * | 12/2010 | Vittapalli | H01R 12/727 439/65 |
| 2012/0322298 | A1 * | 12/2012 | Aime | H01R 13/04 439/510 |
| 2014/0065889 | A1 * | 3/2014 | Zhang | H01R 13/516 439/660 |
| 2015/0056868 | A1 * | 2/2015 | Goossens | H01R 12/7088 439/682 |
| 2015/0357734 | A1 * | 12/2015 | Copper | H01R 13/08 439/660 |
| 2016/0020572 | A1 * | 1/2016 | Ju | H01R 24/78 264/272.14 |
| 2017/0025772 | A1 * | 1/2017 | Yu | H01R 12/724 |
| 2018/0034171 | A1 * | 2/2018 | Tyler | H01R 13/113 |
| 2018/0034178 | A1 * | 2/2018 | Tyler | H01R 13/193 |
| 2019/0044254 | A1 * | 2/2019 | Lybrand | H01R 4/70 |
| 2019/0109408 | A1 * | 4/2019 | Maddens | H01R 13/5025 |
| 2019/0140405 | A1 * | 5/2019 | Kralik | H01R 13/7036 |
| 2020/0313375 | A1 * | 10/2020 | Lybrand | H01R 13/08 |

FOREIGN PATENT DOCUMENTS

| | | | |
|---|---|---|---|
| EP | 2515385 | A1 | 10/2012 |
| TW | 201707306 | A | 2/2017 |
| WO | WO2013/037966 | A1 | 3/2013 |

* cited by examiner

ELECTRICAL CONNECTOR ASSEMBLY WITH COMPLEMENTARY CONTACT UNIT

BACKGROUND OF THE DISCLOSURE

1. Field of the Disclosure

The present disclosure relates to an electrical connector assembly, and more particularly to an electrical connector assembly equipped with the complementary contact unit for compliance with rotational mating.

2. Description of Related Arts

U.S. Pat. No. 9,711,897 discloses an electrical connector assembly including the receptacle connector and the plug connector which are mateable with each other along either a horizontal mating direction or a vertical mating direction. Anyhow, sometimes the contact piece may be split into two parts, i.e., one pair, carrying different electrical characteristics. In such a situation, a specific configuration of such a pair is relatively sensitive for complying with the vertical mating direction. Otherwise, shorting between the unwanted mating parts may occur.

An improved arrangement is desired to have the electrical connector assembly with the corresponding contacts properly arranged with each other in both the dimension and the configuration.

SUMMARY OF THE DISCLOSURE

An object of the invention is to provide an electrical connector assembly with a receptacle connector and a plug connector mateable with each other in either along the front-to-back direction, i.e., the longitudinal direction, or the vertical direction perpendicular to the front-to-back direction, or even a rotational direction. Each of the receptacle connector and the plug connector defines a first mating face and a second mating face perpendicular to each other in response to mating along the front-to-back direction and the vertical direction. Each of the receptacle connector and the plug connector includes a plurality of contacts composed of a plurality of first contacts and a plurality of contact units alternately arranged with each other along the transverse direction perpendicular to both the front-to-back direction and the vertical direction. Each contact unit includes a second contact and a third contact wherein the second contact is closer to the second mating face than the third contact is while the third contact is closer to the first mating face than the second contact is.

The third contact is longer than the second contact in the front-to-back direction. During mating, the second/short contact of the receptacle connector is mated with the third/long contact of the plug connector, and the third/long contact of the receptacle connector is mated with the second/short contact of the plug connector in a complementary manner. Therefore, during the mating procedure along the vertical direction, the second/short contact of the receptacle connector will not contact the second/short contact of the plug connector but in a pass-by condition, before the receptacle connector and the third connector are fully mated.

Other objects, advantages and novel features of the disclosure will become more apparent from the following detailed description when taken in conjunction with the accompanying drawings.

DETAILED DESCRIPTION OF THE PREFERRED EMBODIMENT

Referring to FIGS. 1-10, an electrical connector assembly 100 includes a plug connector 1 and a receptacle connector 2 mateable with each other along either a front-to-back direction A, i.e., longitudinal direction, or a vertical direction B perpendicular to the front-to-back direction A.

Figure 9:
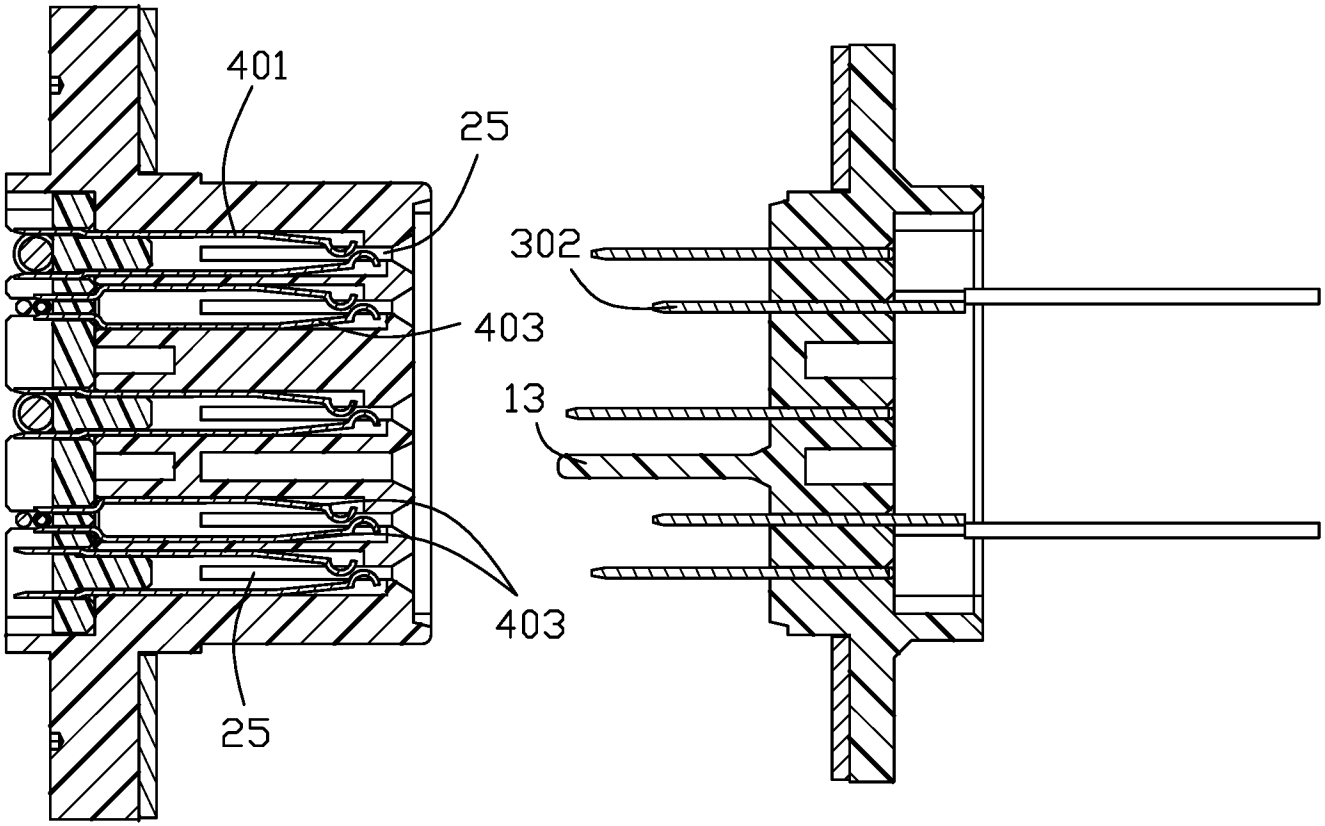
FIG. 9 is a cross-sectional view of the electrical connector assembly of FIG. 3.
Figure 10:
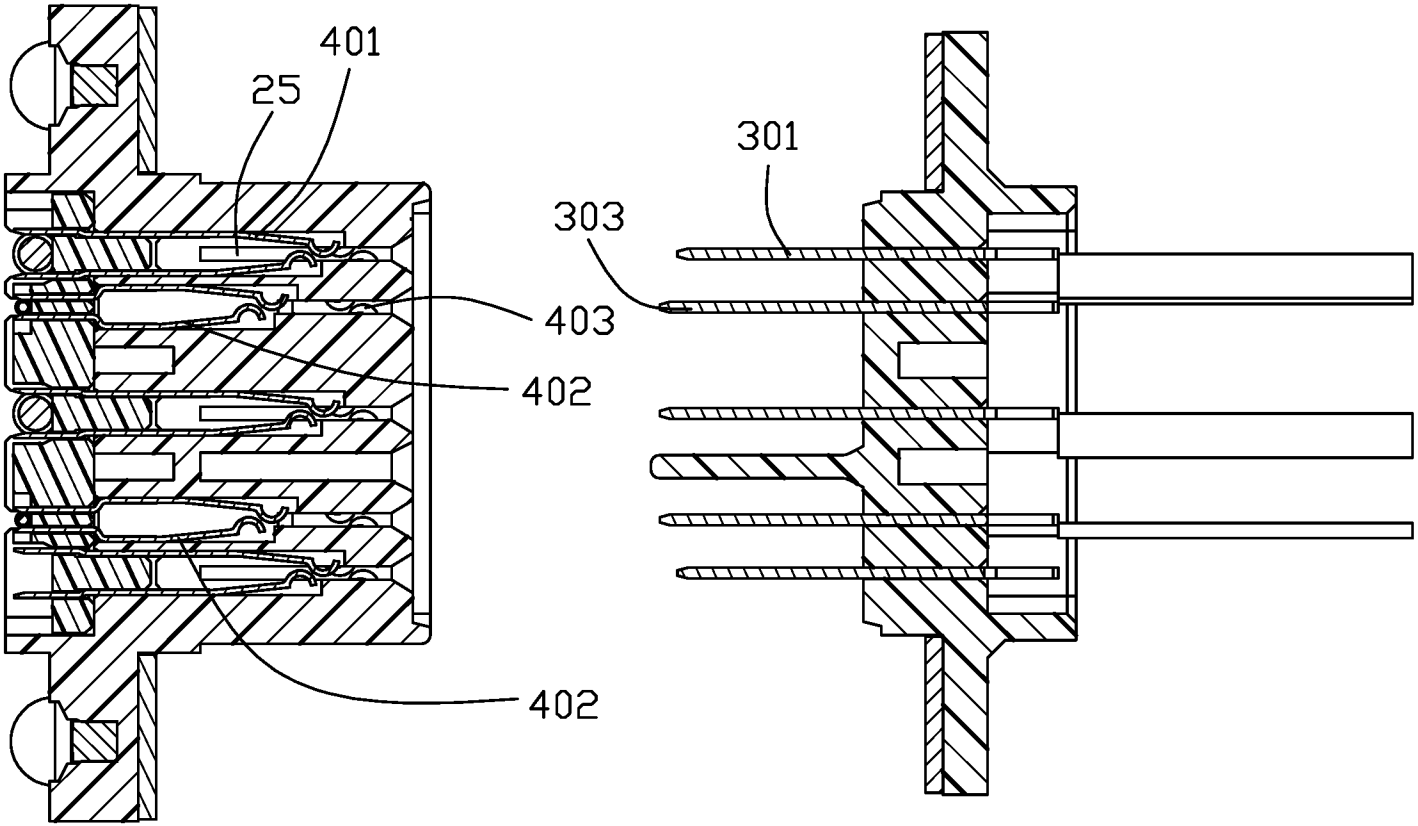
FIG. 10 is another cross-sectional view of the electrical connector assembly of FIG. 3.

The plug connector 1 includes an insulative plug housing 10, a plurality of plug contacts 30 retained to the plug housing 10, and a metal shell 50. The plug housing 10 includes a base 11 and a sidewall 12 extending from one side of the base 11. A plurality of first passageways 14, second passageways 15 and third passageways 16 are formed in the housing 10. The plug contacts 30 include a plurality of first (plug) contacts 301, second (plug) contacts 302 and third (plug) contacts 303, respectively retained in the corresponding first passageways 14, second passageways 15 and third passageways 16, respectively. Notably, the second contacts 302 and the third contacts 303 are paired with each other to form the contact units so as to be alternately arranged with the first contacts 301 along the transverse direction perpendicular to both the front-to-back direction and the vertical direction. All the first contacts 301, the second contacts 302 and the third contacts 303 are of a plate configuration. Each contact 301, 302 and 303 includes a stationary contacting section 34, a retaining section 33 and a soldering section 32. The housing 10 further includes partition 13 perpendicular to both the base 11 and the sidewall 12 for alignment during mating, and parallel to the plug contacts 30. The housing 10 forms a first mating face 1001 facing to the exterior in the front-to-back direction A, and the second mating face 1002 facing to the exterior in the vertical direction B. In this embodiment, in a side view the dimensions of the partition 13 and those of the contacting section 34 of the first contact 301, the third contact 303 and the second contact 302 are sequential with one another. In other words, in the contact unit composed by the third contact 303 and the second contact 302, the third contact 303 is a long contact while the second contact 302 is a short contact. As shown in FIGS. 9 and 10, the front edge of the contacting section 34 of the third contact 303 is closer to the first mating face 1001 than those of the first contact 301 and the second contact 302. The metal shell 50 is attached upon the front face of the base 11.

The receptacle connector 2 includes an insulative receptacle housing 20, a plurality of receptacle contacts 40 retained in the housing 20, and a metallic shell 60 attached upon a front face of the housing 20. The receptacle housing 20 includes a base 21 and a mating portion 22 extending forwardly from the base 21 along the front-to-back direction. The housing 20 forms a first mating face/side 2001 facing to the exterior along the front-to-back direction A and a second mating face/side 2002 facing to the exterior along the vertical direction B. The first mating face 1001 of the plug connector 1 is mated with the first mating face 2001 of the receptacle connector 2, and the second mating face 1002 of the plug connector 1 is mated with the second mating face 2002 of the receptacle connector 2. The mating portion 22 forms a plurality of dividers 23 to form the corresponding mating slots 25. One of the dividers 23 is thickened to be a key 24. The contacts 40 include a plurality of first (receptacle) contacts 401, second (receptacle) contacts 402, and third (receptacle) contacts 403 all extending within the corresponding mating slots 25, respectively, wherein each first contact 401 occupies one mating slot 25 while one second contact 402 and one third contact 403 share the same mating slot 25. In other words, the second contacts 402 and the third contacts 403 are paired with each other to form the contact units wherein the second contact 402 is a short one while the third contact 403 is a long one. Each contact 40 includes a resilient contacting section 44, the retaining section 43 and the soldering section 42. Each contact 40 is composed of two spaced pieces for commonly sandwiching the blade type contacting section 34 of the plug connector 3. The first contact 401 is largest and each piece includes two different-length deflectable arms side by side arranged with each other in the vertical direction while each of the second contact 402 and the third contact 403 only has one deflectable arm on each piece.

Figure 1:
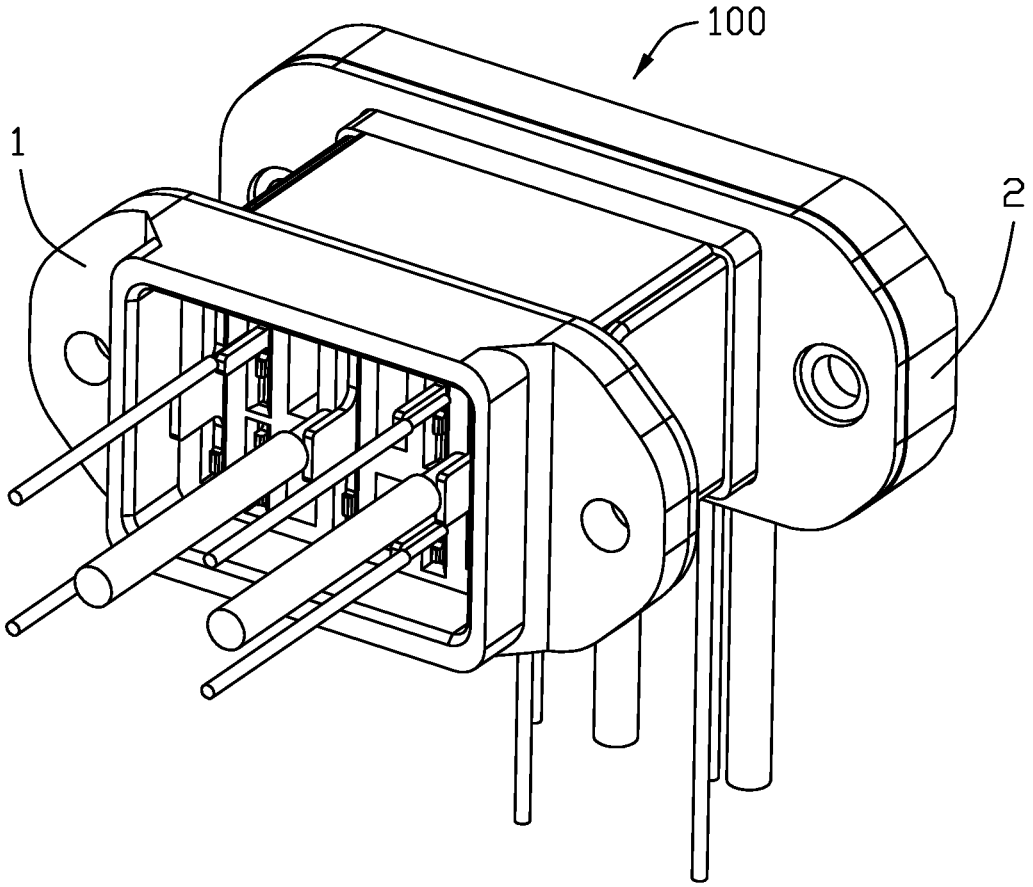
FIG. 1 is a perspective view of an electrical connector assembly according to the invention.
Figure 2:
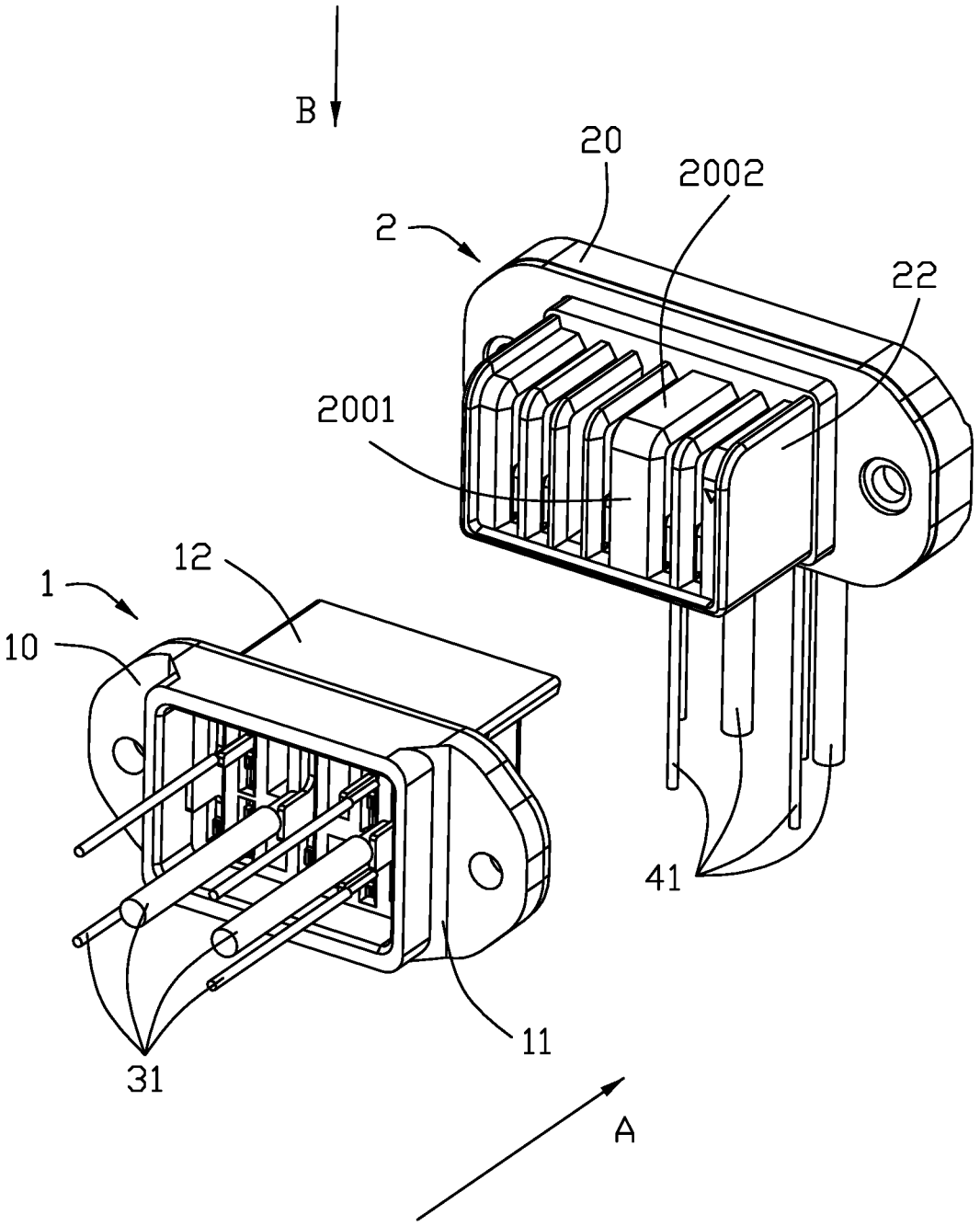
FIG. 2 is an exploded perspective view of the electrical connector assembly of FIG. 1.
Figure 3:
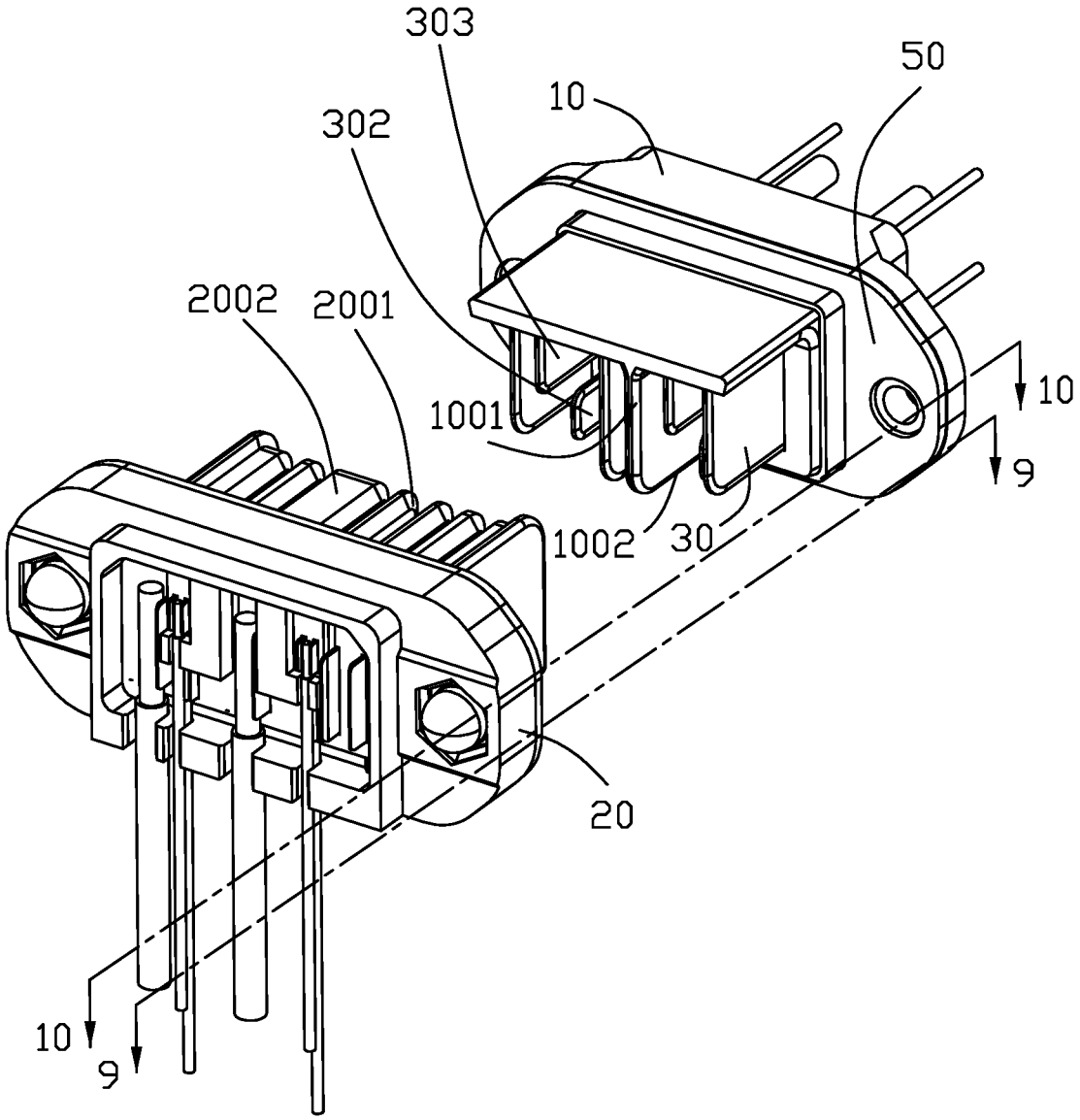
FIG. 3 is another exploded perspective view of the electrical connector assembly of FIG. 2.
Figure 4:
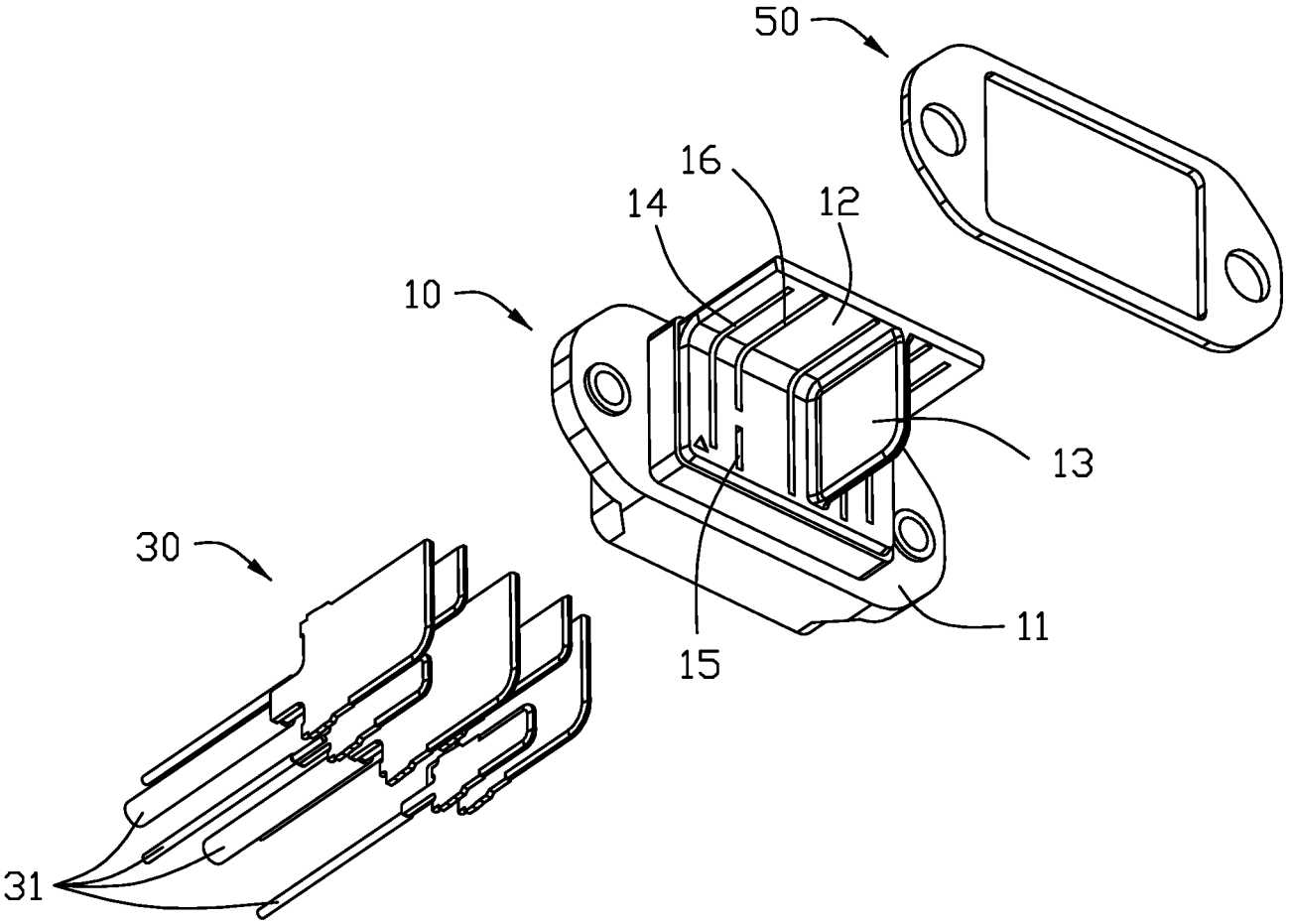
FIG. 4 is an exploded perspective view of the plug connector of the electrical connector assembly of FIG. 2.
Figure 5:
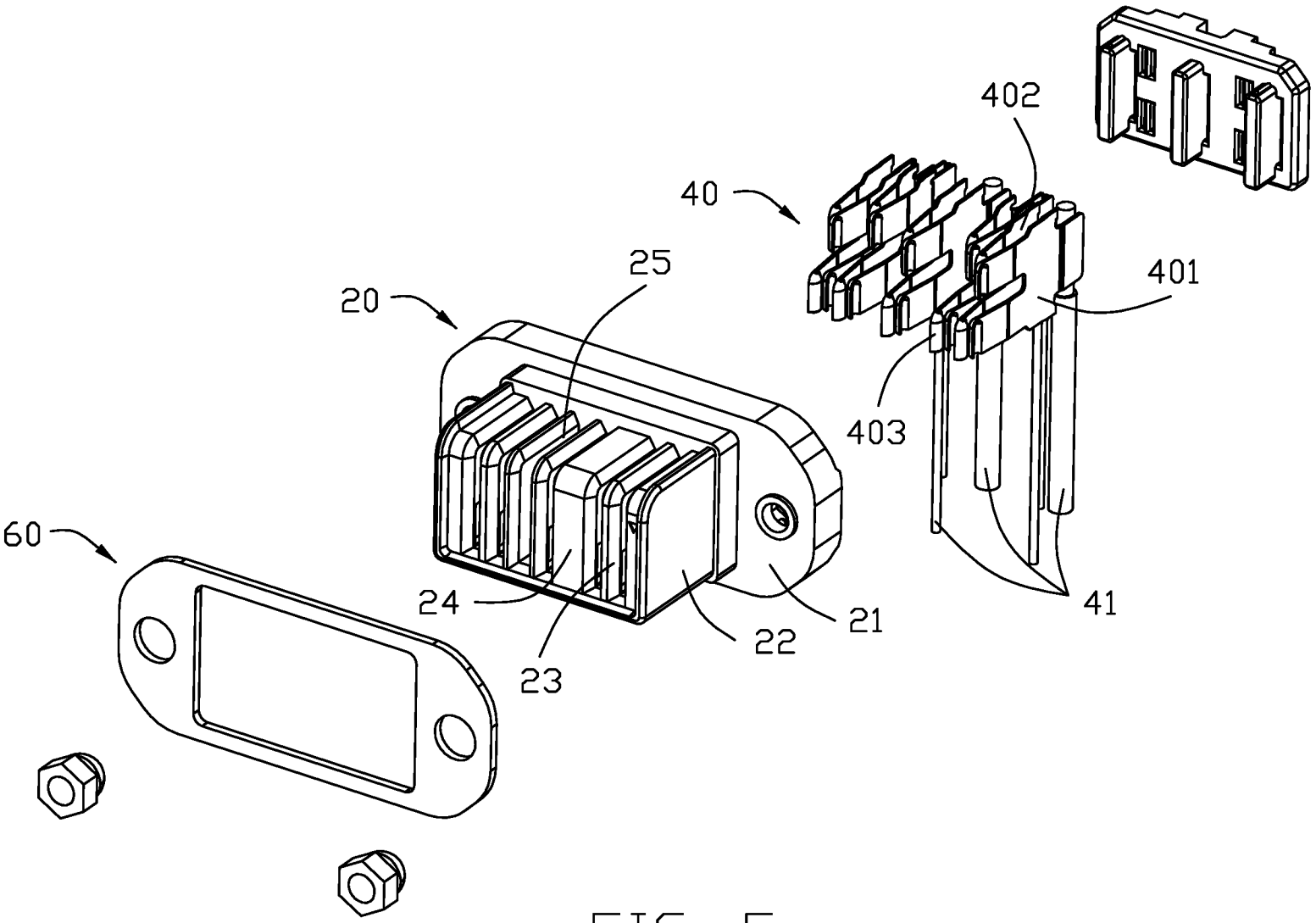
FIG. 5 is an exploded perspective view of the receptacle connector of the electrical connector assembly of FIG. 2.
Figure 6:
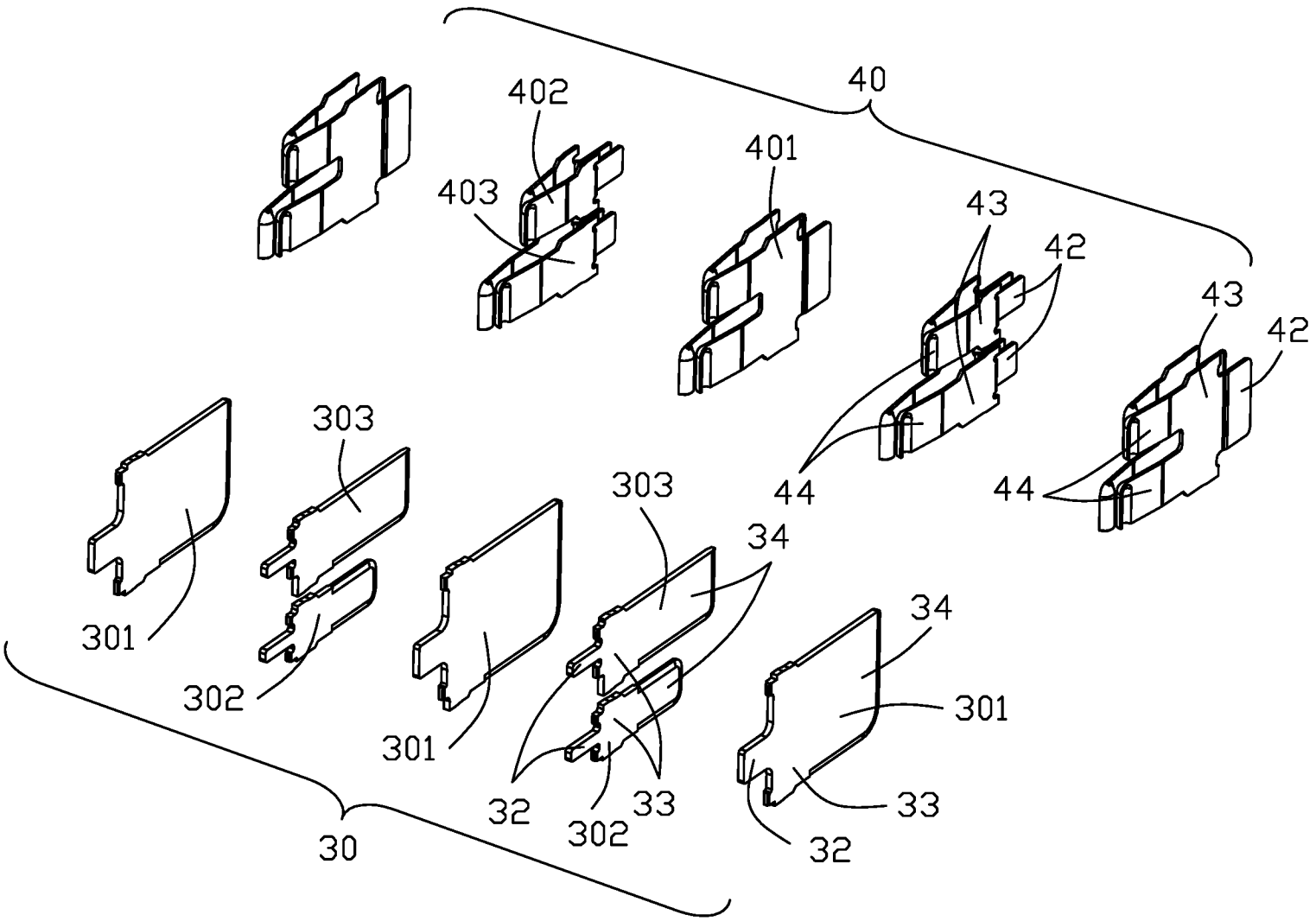
FIG. 6 is an exploded perspective view of the plug contacts and the receptacle contacts of the electrical connector assembly of FIG. 2.
Figure 7:
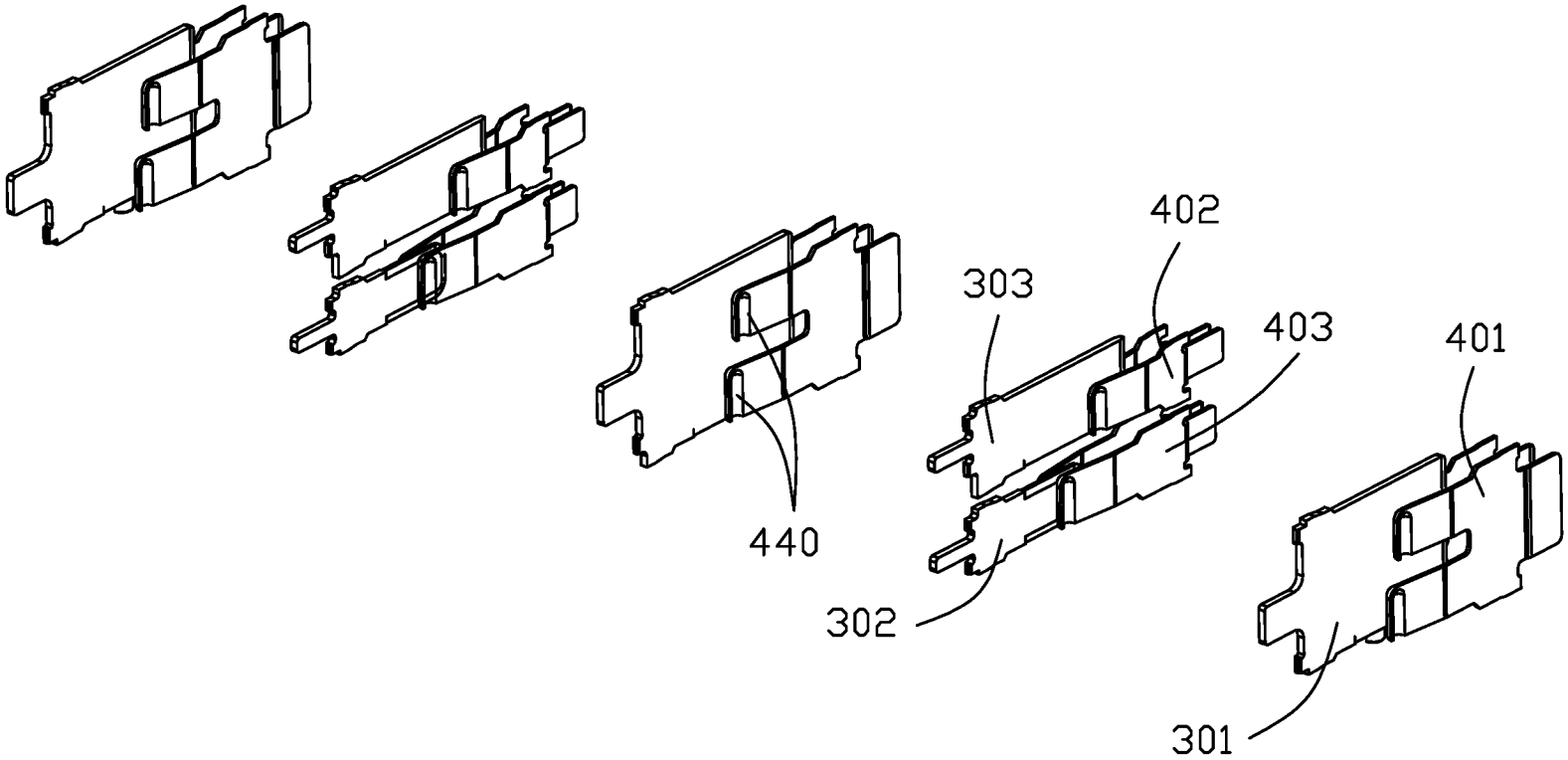
FIG. 7 is a perspective view of the receptacle contacts of and the plug contacts of the electrical connector assembly of FIG. 1.

Referring to both FIGS. 2 and 6, the plug connector 1 can be mated with the receptacle connector 2 along the front-to-back direction. Understandably, the plug contacts 30 are inserted into the corresponding mating slots 25 to be mated with the clamping type receptacle contacts 40. In this embodiment, the contacting section 34 of the first (plug) contact 301 first contacts both deflectable arms of the contacting section 44 of the corresponding first (receptacle) contact 401. Successively, both the contacting section 34 of the second (plug) contact 302 and the contacting section 34 of the third (plug) contact 303 can essentially simultaneously contact the contacting section 44 of the corresponding second (receptacle) contact 402 and the contacting section 44 of the corresponding (receptacle) contact 403. It is because the contacting section 34 of the second (plug) contact 302 and the contacting section 34 of the third (receptacle) contact 403 are complementary with each other as well as the contacting section 34 of the third (plug) contact 303 and the contacting section 34 of the second (receptacle) contact 402 are complementary with each other. The three first contacts 301 or 401 can be one power contact, one grounding contact and one standby contact ready for use. In each of the plug connector 1 and the receptacle connector 2, the two contact units each including one second contact 302, 402 and one third contact 303, 403, are used for signal transmission.

Figure 8:
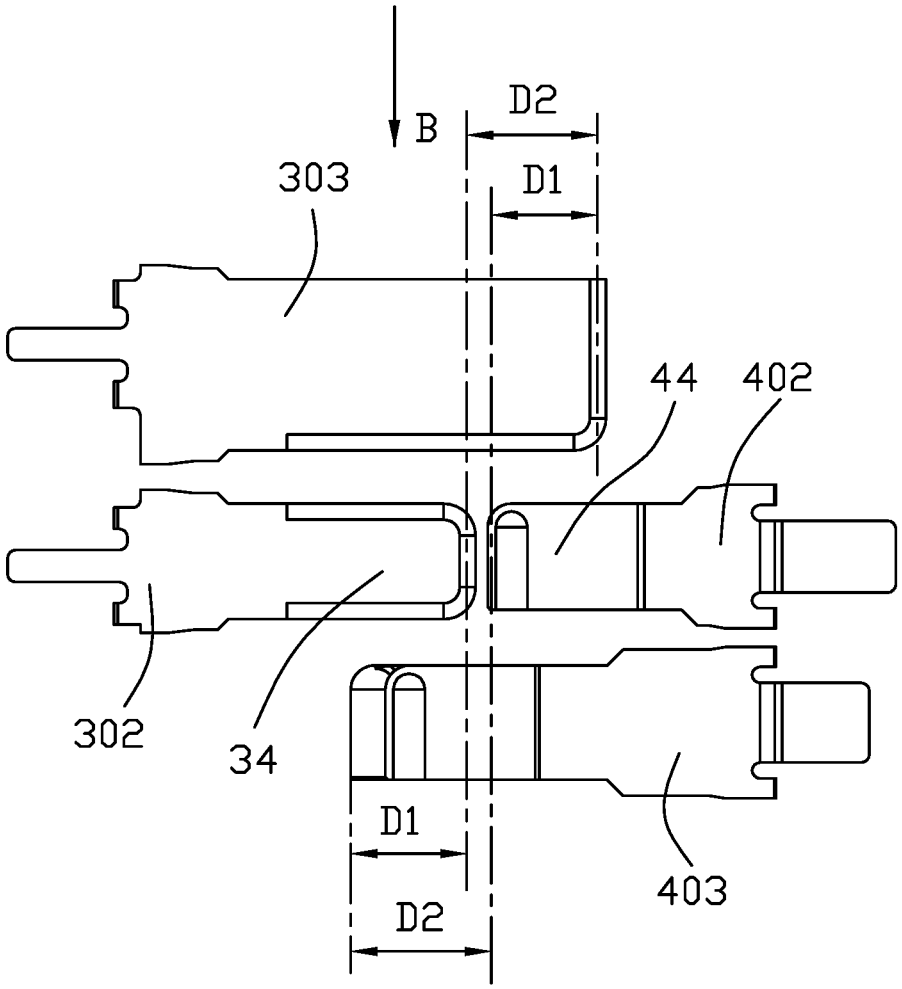
FIG. 8 is a side view of the mated receptacle contacts and plug contacts of the electrical connector assembly of FIG. 1 in a mating procedure along the vertical direction.

In brief, the contact unit of the receptacle connector 2 composed of the long contact 403 and the short contact 402, may be complementarily mated with the corresponding contact unit composed of the long contact 303 and the short contact 302 wherein the long contact 403 is mated with the short contact 302 while the short contact 402 is mated with the long contact 303 in a complementary manner. As shown in FIG. 8, during mating there is no possibility to have the short contact 302 and the short contact 402 contact each other due to corresponding lengths. Understandably, in the receptacle connector 2, the long contact 403 is closer to the first mating face 2001 than the short contact 402 is while the short contact 402 is closer to the second mating face 2002 than the long contact 403 is.

Notably, the reason why the contact unit is required to have the paired second and third contacts with different lengths is to avoid the improper connection between the second contact 302 of the plug connector 1 and the second contact 402 of the receptacle connector 2 during the mating procedure along the vertical direction or a rotational direction wherein the second mating face 1002 of the plug connector 1 and the second mating face 2002 of the receptacle connector 2 approach each other to have the second (plug) contact 302 inevitably encounter the second (receptacle) contact 402 to result in an improper shorting therebetween before allowing the second (plug) contact 302 to correctly connect the third (receptacle) contact 403 and/or the second (receptacle) contact 402 to correctly connect the third (plug) contact 303. Understandably, if the second (plug) contact 302 and the third (plug) contact 303 are arranged with the similar or same length thereof, such an improper situation will occur when the plug connector 1 and the receptacle connector 2 are mated in the vertical direction or the rotational direction. In opposite, in the instant invention because the second (plug, receptacle) contact 302, 402 is much shorter than the third (plug, receptacle) contact 303, 403, such a potential risk defect can be avoided.

In this embodiment, the pair of deflectable arms of the contacting section 44 of the second (receptacle) contact 402 have the different height contacting points with regard to the corresponding same blade type contacting section 34 of the second (plug) contact 302. Referring to FIGS. 9 and 10, the different contact points of the second (receptacle) contact 402 are that on the left side higher than that one the right side. Differently, the pair of deflectable arms of the contacting section 44 of the third (receptacle) contact 403 have the different height contacting points with regard to the corresponding same blade type contacting section of the third contact 303 while the different contacting points of the third (receptacle) contact 403 are that on the right side higher than that on the left side. Understandably, such an arrangement may result in opposite twisting directions upon the corresponding blade type plug contact so as to counterbalance the forces of all the contacts during mating.

As shown in FIG. 10, in this embodiment, in the plug connector 1, the length of the contacting section 34 of the long/third (plug) contact 303 is longer than that of the first (plug) contact 302 on two outmost sides while shorter than that of the first (plug) contact 302 in the middle. Anyhow, because such the long/third (plug) contact 303 is designated to be mated with the short/second (receptacle) contact 402, such a mating only occurs after the first (plug) contact 301 is mated with the first (receptacle) contact 401, thus assuring grounding/power between the first (plug) contact 301 and the first (receptacle) contact 401 is connected before the signal between the long/third (plug) contact (303) and the short/second (receptacle) contact 402 is connected for transmission protection advantageously. Correspondingly, as shown in FIG. 9, in this embodiment, in the receptacle connector 2, the length of the contacting section 34 of the long/third (receptacle) contact 403 is similar to that of the first contact 401. Anyhow, because such the long/third (receptacle) contact 403 is designated to be mated with the short/second (plug) contact 302, thus assuring grounding power between the first (plug) contact 301 and the first (receptacle) contact (401) is connected before the signal between the long/third (receptacle) contact 403 and the short/second (plug) contact 302 is connected for transmission protection advantageously.

In this embodiment, both the plug connector 1 and the receptacle connector 2 are connected to the wires 31. As shown in FIG. 8, to assure no improper contact between the second (plug) contact 302 and the second (receptacle) contact 402, the front end of the third (plug) contact 303 is spaced from the front end of the second (plug) contact 302 with a distance D2 which should be larger than the distance D1 of the required mating area between the second (receptacle) contact 402 and the second (plug) contact 303, as well as those applied to second (plug) contact 302 and the third (receptacle) contact 403.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector assembly comprising:

a plug connector including an insulative plug housing and a plurality of plug contacts retained therein, said plug housing defining a first plug mating face facing toward an exterior along a front-to-back direction, and a second plug mating face facing toward the exterior in a vertical direction perpendicular to the front-to-back direction, the plug contacts including a plurality of plug contact units each having a long plug contact and a short plug contact sharing substantially a same location along a transverse direction perpendicular to both the front-to-back direction and the vertical direction while being spaced from each other in said vertical direction wherein the long plug contact is closer to the first plug mating face than the short plug contact is while the short plug contact is closer to the second plug mating face than the long plug contact is;

a receptacle connector including an insulative receptacle housing and a plurality of receptacle contacts retained therein, said receptacle housing defining a first mating side facing toward the exterior along the front-to-back direction, and a second mating side facing toward the exterior along the vertical direction, said receptacle housing forming a plurality of mating slots spaced from one another along said transverse direction;

the receptacle contacts including a plurality of receptacle contact units each having a long receptacle contact and a short receptacle contact located in the same mating slot while being spaced from each other in the vertical direction wherein the long receptacle contact is closer to the first receptacle mating side than the short receptacle contact is while the short receptacle contact is closer to the second receptacle mating side than the long receptacle contact is; wherein the plug connector is adapted to be mated with the receptacle connector either along the front-to-back direction via confrontation between the first plug mating face of the plug connector and the first receptacle mating side of the receptacle connector, or along the vertical direction via confrontation between the second plug mating face of the plug connector and the second receptacle mating side of the receptacle connector.

2. The electrical connector assembly as claimed in claim 1, wherein the short plug contact and the short receptacle contact cannot contact each other under mating along the vertical direction or via rotation.

3. The electrical connector assembly as claimed in claim 1, wherein the long plug contact and the short receptacle contact abut complementarily with each other for mating, and the short plug contact and the long receptacle contact abut complementarily with each other for mating.

4. The electrical connector assembly as claimed in claim 3, wherein the long plug contact and the short receptacle contact are mated with each other at the same time when the short plug contact and the long receptacle contact are mated with each other.

5. The electrical connector assembly as claimed in claim 1, wherein the long receptacle contact is of a clamping type having two long deflectable arms with different height contacting points to result in a twisting direction upon the long plug contact, and the short receptacle contact is of a clamping type having two short deflectable arms with different height contacting points to result in another twisting direction, which is opposite to the twisting direction, upon the short plug contact.

6. The electrical connector assembly as claimed in claim 5, wherein the plug contacts further include a plurality of power/grounding plug contacts having a similar length with the long plug contact, and the receptacle contacts further include a plurality of power/grounding receptacle contacts having a similar length with the long receptacle contact for mating with the corresponding power/grounding plug contacts, respectively.

7. The electrical connector assembly as claimed in claim 6, wherein the power/grounding receptacle contact includes a pair of long deflectable arms and a pair of short deflectable arms spaced from each other in the vertical direction, and the pair of long deflectable arms are dimensioned to be similar to the long receptacle contact along the front-to-back direction, and the pair of short deflectable arms are dimensioned to be longer than the short receptacle contact in the front-to-back direction.

8. The electrical connector assembly as claimed in claim 7, wherein all the power/grounding receptacle contact, the power/grounding plug contact, the long receptacle contact and the short plug contact, the short receptacle contact and the long plug contact are dimensioned along the front-to-back direction to have the power/grounding receptacle contact completely mated with the corresponding power/grounding plug contact before the long plug contact is mated with the short receptacle contact and the short plug contact is mated with the long receptacle contact during mating along the front-to-back direction.

9. The electrical connector assembly as claimed in claim 6, wherein the twisting direction results from the pair of long deflectable arms is opposite to that results from the pair of short deflectable arms.

10. The electrical connector assembly as claimed in claim 7, wherein the pair of long deflectable arms of the power/grounding receptacle contacts are located at a same vertical cross-sectional plane with the long receptacle contacts taken along the transverse direction, and the pair of short deflectable arms of the power, and the short deflectable arms of the power/grounding receptacle contacts are located at another same vertical cross-sectional plane with the short receptacle contacts taken along the transverse direction.

11. The electrical connector assembly as claimed in claim 1, wherein during mating, the long plug contacts are mated with the short receptacle contacts, while the short plug contacts are mated with the long receptacle contacts.

12. The electrical connector assembly as claimed in claim 1, wherein the receptacle connector is connected to a plurality of wires extending in the vertical direction while the plug connector is connected to a plurality of wires extending in the front-to-back direction.

13. A method of mating an electrical connector assembly, comprising steps of:

providing a plug connector with a long plug contact and a short plug contact sharing a same position along a transverse direction, wherein the long plug contact is closer to a first plug mating face thereof, which faces toward an exterior along a front-to-back direction perpendicular to the transverse direction, than the short plug contact is, while the short plug contact is closer to a second plug mating face thereof, which faces toward the exterior along a vertical direction perpendicular to both the transverse direction and the front-to-back direction, than the long plug contact is;

providing a receptacle connector with a long receptacle contact and a short receptacle contact sharing within a same mating slot therein, wherein the long receptacle contact is closer to a first receptacle mating side thereof, which faces toward the exterior along the front-to-back direction, than the short receptacle contact is, while the short receptacle contact is closer to second receptacle mating side, which faces toward the exterior along the vertical direction, than the long receptacle contact is; and mating the plug connector into the receptacle connector either along the front-to-back direction via confrontation between the first plug mating face of the plug connector and the first receptacle mating side of the receptacle connector, or along the vertical direction via confrontation between the second plug mating face of the plug connector and the second receptacle mating side of the receptacle connector to have the long plug contact mated with the short receptacle contact, and the short plug contact mated with the long receptacle contact without risks of shorting between the short plug contact and the short receptacle contact during a mating procedure along the vertical direction.

14. The method as claimed in claim 13, wherein both the long receptacle contact and the short receptacle contact are of a clamping type with a pair of deflectable arms with different height contacting points, and a twisting direction results from the long receptacle contact is opposite to that resulting from the short receptacle contact.

15. The method as claimed in claim 14, wherein the receptacle connector further includes a power/grounding receptacle contact with a pair of long deflectable arms aligned with the long receptacle contact in the transverse direction, and a pair of short deflectable arms aligned with the short receptacle contact in the transverse direction.

16. The method as claimed in claim 15, wherein a length of the long deflectable arms of the power/grounding receptacle contact is similar to that of the long receptacle contact in the front-to-back direction, while a length of the short deflectable arms of the power/grounding receptacle contact is longer than that of the short receptacle contact in the front-to-back direction.

17. The method as claimed in claim 16, wherein all the power/grounding receptacle contact, the power/grounding plug contact, the long receptacle contact and the short plug contact, the short receptacle contact and the long plug contact are dimensioned along the front-to-back direction to have the power/grounding receptacle contact completely mated with the corresponding power/grounding plug contact before the long plug contact is mated with the short receptacle contact and the short plug contact is mated with the long receptacle contact during mating along the front-to-back direction.

18. An electrical connector for mating with a complementary connector comprising:

an insulative housing defining a first mating face facing toward an exterior along a front-to-back direction, and a second mating face facing toward the exterior in a vertical direction perpendicular to the front-to-back direction;

a first contact and a second contact located at a same position in a transverse direction perpendicular to both the front-to-back direction and the vertical direction; wherein the mating port including a plurality of mating cavities spaced from one another in a vertical direction;

the first contact is closer to the first mating face than the second contact is along the front-to-back direction while the second contact is closer to the second mating face than the first contact is along the vertical direction.

19. The electrical connector as claimed in claim 18, wherein the first contact is longer than the second contact in the front-to-back direction.

20. The electrical connector as claimed in claim 18, wherein a distance between a front end of the long contact and that of the short contact is larger than a distance between a front end of the long contact and that of the short mating contact with a corresponding mating contact of the complementary connector along the front-to-back direction.

* * * * *